US008028854B2

(12) United States Patent
Sofy et al.

(10) Patent No.: US 8,028,854 B2
(45) Date of Patent: Oct. 4, 2011

(54) PIVOT LID WASTE BASKET

(75) Inventors: Janet M. Sofy, Troy, MI (US); Robert W. Patterson, Ann Arbor, MI (US); Scott M. Luplow, Royal Oak, MI (US)

(73) Assignee: HMS Manufacturing Company, Troy, MI (US)

( * ) Notice: Subject to any disclaimer, the term of this patent is extended or adjusted under 35 U.S.C. 154(b) by 61 days.

(21) Appl. No.: 12/804,819

(22) Filed: Aug. 20, 2008

(65) Prior Publication Data

US 2010/0308068 A1 Dec. 9, 2010

(51) Int. Cl.
*B65D 51/18* (2006.01)
*B65D 43/18* (2006.01)

(52) U.S. Cl. ..... 220/820; 220/254.1; 220/254.2; 220/254.3; 220/254.5; 220/810; 220/823; 220/824; 220/825; 220/826; 220/908

(58) Field of Classification Search ..... 220/254.1, 220/254.2, 254.3, 254.5, 810, 820, 823, 824, 220/825, 826, 908
See application file for complete search history.

(56) References Cited

U.S. PATENT DOCUMENTS

| | | | | |
|---|---|---|---|---|
| 814,354 | A | | 3/1906 | Carter |
| 2,994,453 | A | | 8/1961 | Gardiner |
| 3,083,859 | A | | 4/1963 | Gardiner |
| 3,247,527 | A | | 4/1966 | Mizelle |
| 4,032,037 | A | | 6/1977 | Dubery et al. |
| 4,679,700 | A | * | 7/1987 | Tharrington et al. ..... 220/825 |
| 4,776,478 | A | | 10/1988 | Millet et al. |
| D358,918 | S | * | 5/1995 | Gale ..... D34/11 |
| 5,611,450 | A | | 3/1997 | DeMars |
| 6,533,656 | B2 | | 3/2003 | Hertel |
| 6,837,393 | B1 | | 1/2005 | Kuo |
| 2003/0201267 | A1 | | 10/2003 | Yang et al. |
| 2006/0042153 | A1 | | 3/2006 | Bowerman |

* cited by examiner

*Primary Examiner* — Anthony Stashick
*Assistant Examiner* — Madison L Wright
(74) *Attorney, Agent, or Firm* — Dickinson Wright PLLC; Harold W. Milton, Jr.

(57) ABSTRACT

The subject invention is a lid assembly (20) for use on a container (22) presenting an endless top rim (24). A frame (26) includes shell-shaped sidewalls (36) that face one another, and present upper concave central edges (48). The upper concave central edges (48) are connected by lower edges (50) to define opposed L-shaped openings (54) between the central edges (48). A pair of abutting L-shaped flaps (28) each define a top leg (64) and a side leg (68). The flaps (28) are complementary to the L-shaped openings (54) by extending away from each other along the upper central edges (48) of the sidewalls (36) and then downward to the lower edge (50). The top legs (64) may be pushed down into the opening (54) to provide access to the container (22) while the side legs (68) bias the flaps (28) to a closed position.

16 Claims, 4 Drawing Sheets

PIVOT LID WASTE BASKET

BACKGROUND OF THE INVENTION

1. Field of the Invention

This invention relates to a lid assembly for a container of the type receiving trash.

2. Description of the Prior Art

Lid assemblies for containers of the type for receiving trash typically include a frame that engages the container and which supports one or two flaps that are disposed in an opening and rotate to permit access through an opening to the container. Such frames include a bottom periphery that defines a radial leg to engage the container and a depending leg to surround the rim of the container to keep the frame in position over the container and walls that extend upwardly from the radial leg to support the flaps and define the opening.

For example, U.S. Pat. No. 3,083,859 discloses a lid assembly with a frame that defines an opening and supports a pair of flat closure flaps. The frame includes walls that extend from the bottom periphery up to the flaps on each side in order to enclose the sides of the lid assembly and support the flaps. The flaps include hinge pins that are disposed in hinge holes which are defined by the frame. The frame also includes flap jambs that extend into the opening and prevent the flaps from moving past the closed position as well as past a maximum open position. The flap jambs extend into the opening between the hinge pins where the flaps rotate down into the opening. The flap jambs limit the area available for access into the container when the flaps are in the open position. The center of mass of the flaps is affected by counterweights suspended underneath the flaps. As the flaps rotate from the closed position to the open position, the suspended counterweights rotate out from inside the lid assembly.

Another example is U.S. Pat. No. 4,032,037 which discloses a lid assembly including a frame with an opening and a single flap that has one leg for closing the opening in the frame that provides access to the container and a second leg descending down into the opening to counterweight the flap to a closed position. The frame includes frame walls as well as one section that extends out over and encloses the leg that descends into the opening.

SUMMARY OF THE INVENTION AND ADVANTAGES

The subject invention provides such a lid assembly including sidewalls that are shell-shaped and face one another with each of the sidewalls presenting an upper concave central edge that runs along the top of the sidewall. The central edges are interconnected by lower edges presented by short walls to define opposed L-shaped openings in the frame, so that the openings are disposed between the upper concave central edges and extend downwards to the lower edges. A pair of identical movable closure flaps, each having an L-shaped cross-section is complementary to and disposed in the L-shaped openings and abutting one another at respective abutting ends to extend away from one another from the abutting ends, along the central edge and downward to a lower end along the lower edge in the closed position.

ADVANTAGES OF THE INVENTION

The present design features two L-shaped flaps whose side legs enclose the frame in the closed position and simultaneously they ingeniously conceal the hinge pins, hinge holes and other functional elements. Concealing the functional elements of the lid assembly, including during the operation of the moving parts, produces a cleaner and more aesthetically pleasing form, and this invention accomplishes a clean and aesthetic form without adding excess material or weight.

Another surprising and unexpected result of this invention is that the flap jambs that are necessary to prevent the flaps from rotating past the closed position are incorporated into the walls of the frame away from the top legs and the abutting ends of the flaps hinge. In this location the jambs are not visible when the flaps are in the closed position and do not disrupt the design attractiveness. Additionally, in this location the flap jambs do not obstruct or narrow the access through the opening to the container.

Many lid assemblies of this type are used in office, home, hotel, or food service environments where common-use containers are functional necessities. However, an unsightly lid assembly has a negative impact on the professional appearance of the office or becomes an unwanted and unappealing eyesore in the home, hotel, restaurant or similar environments. The present invention presents ingenious improvements in functionality while making possible pleasing, aesthetically operating designs that do not detract from an attractive, professional work environment, or from a positive ambiance sought in a home or business.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
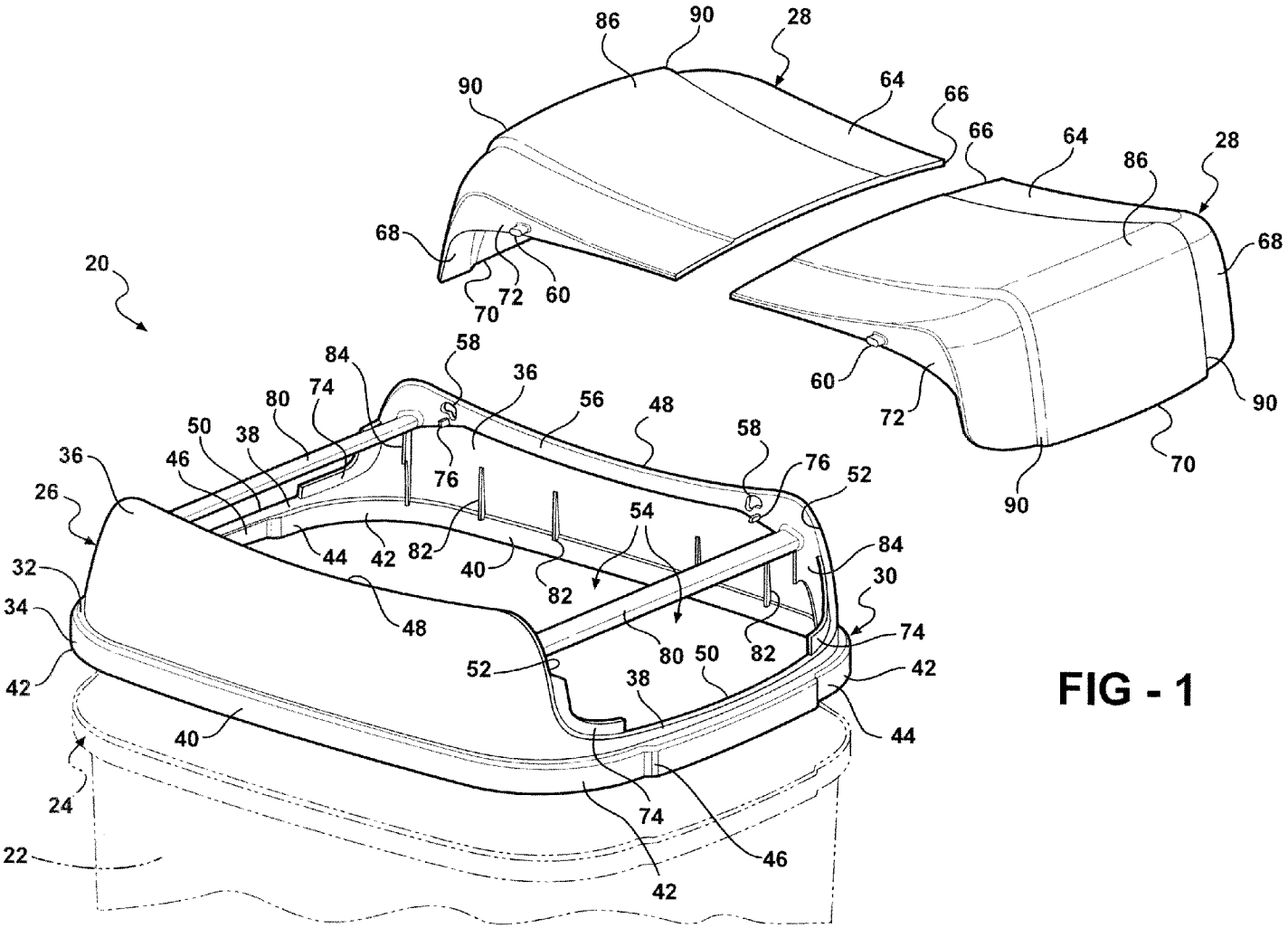
FIG. 1 is an exploded perspective view of the lid assembly and container.
Figure 2:
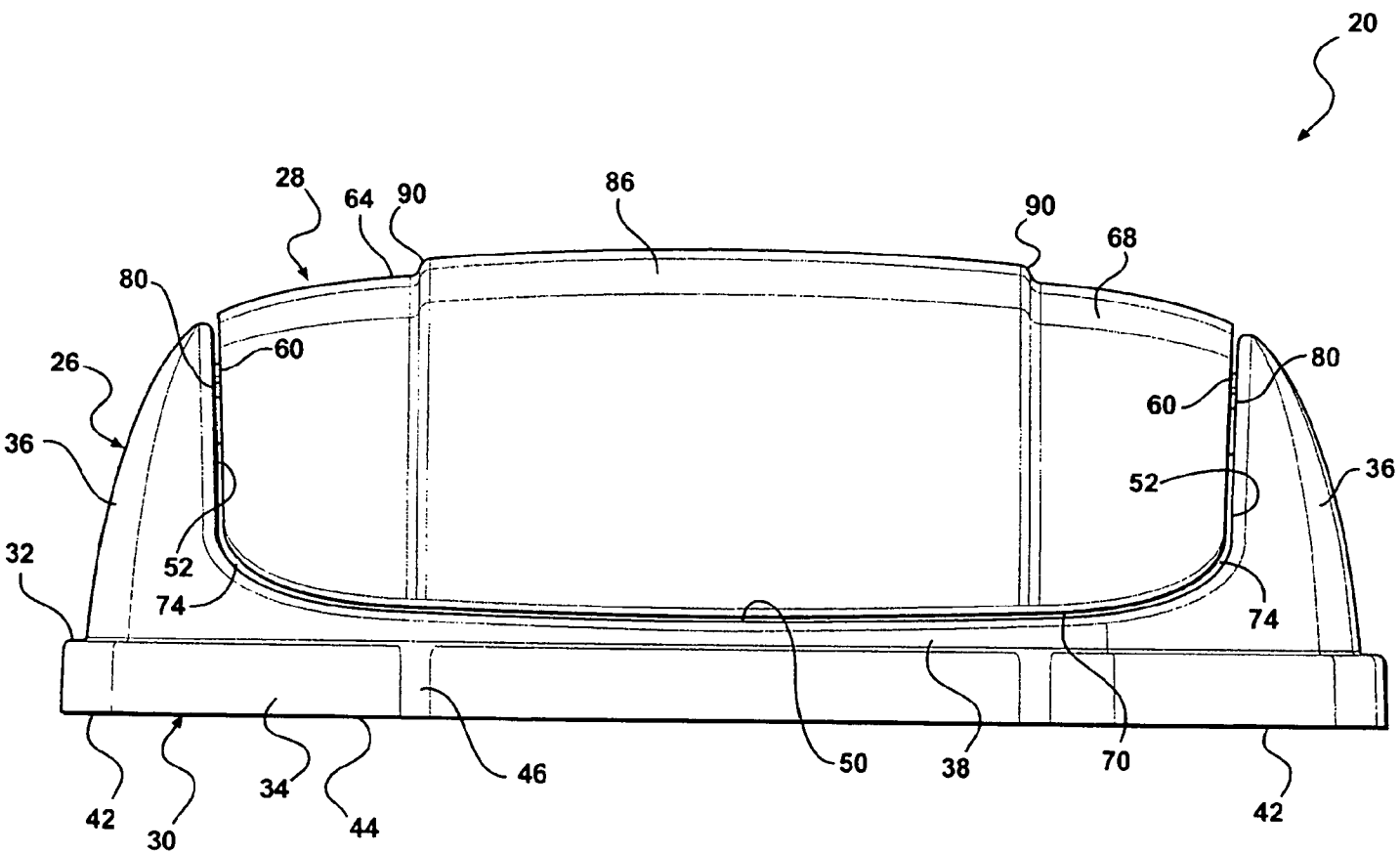
FIG. 2 is an end view of the lid assembly.
Figure 3:
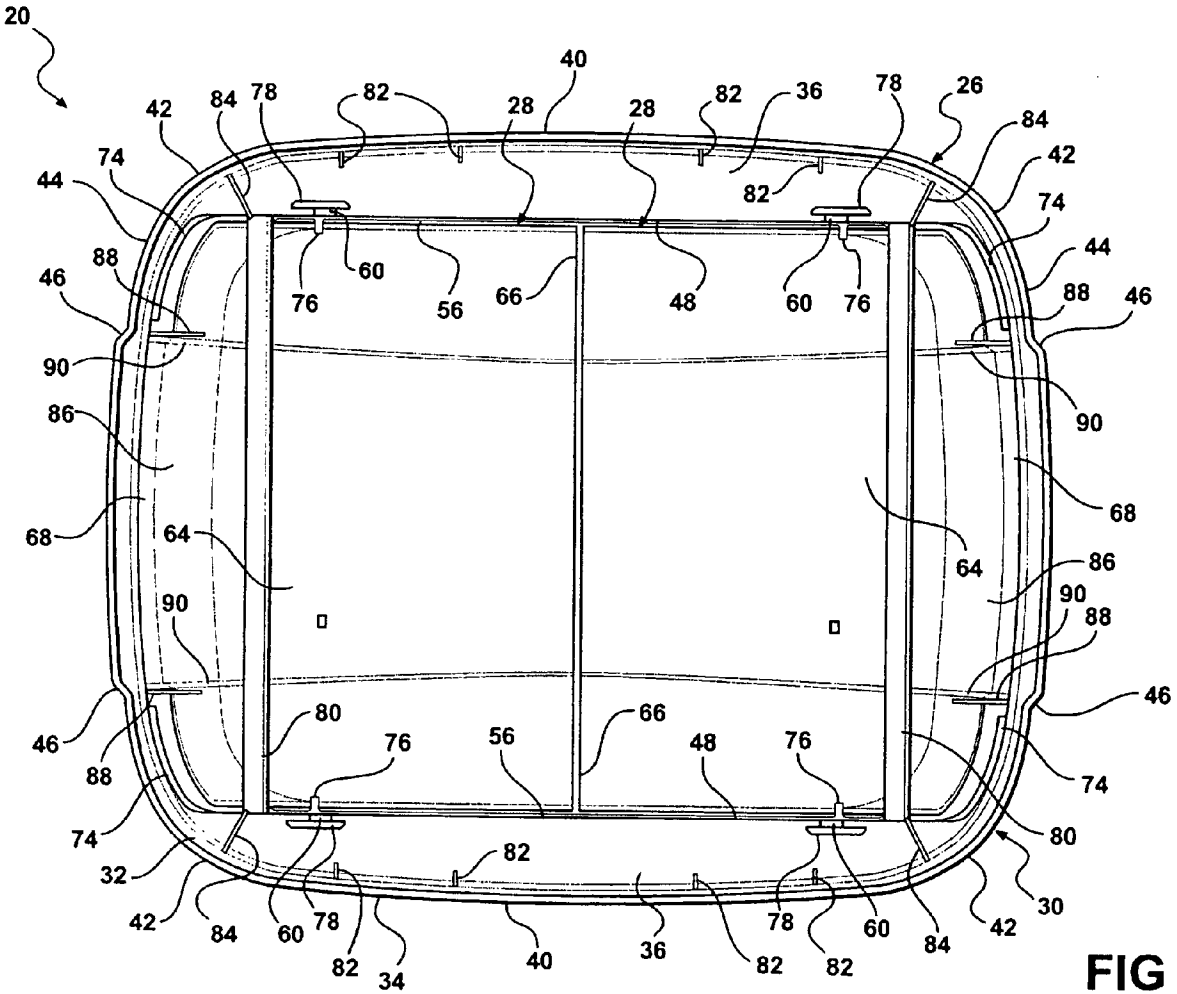
FIG. 3 is a bottom view of the lid assembly.
Figure 4:
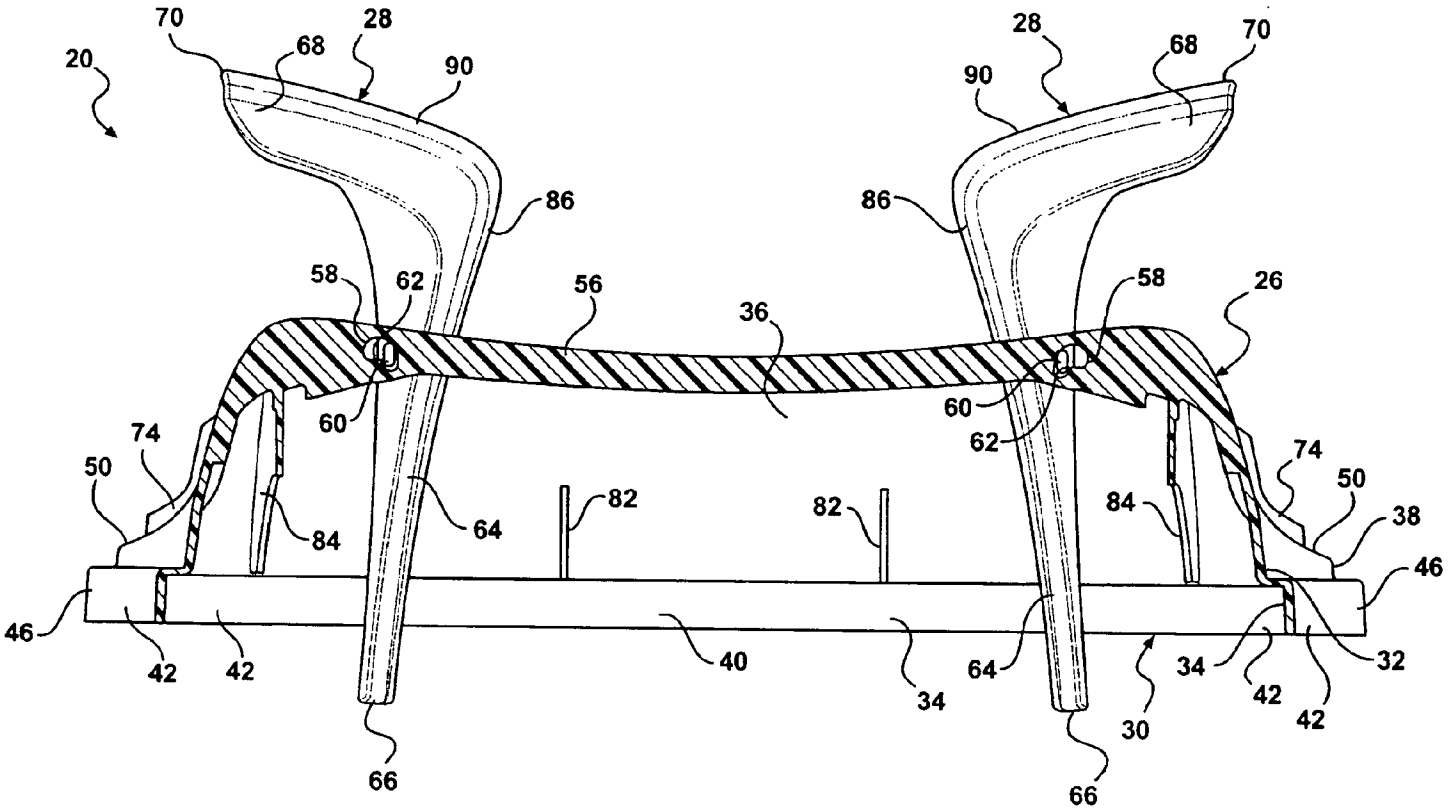
FIG. 4 is a cross-sectional view taken along line 3-3 of FIG. 2.

Referring to the Figures, wherein like numerals indicate corresponding parts throughout the several views, the subject lid assembly 20 generally shown is for a container 22 of the type presenting an endless top rim 24 (a trash can is a common example). The lid assembly 20 includes a frame 26 generally indicated that engages the container 22 and supports closure flaps 28 each generally indicated. To engage the container 22, the frame 26 includes a bottom periphery 30 generally indicated that has an L-shaped cross-section that defines a radial leg 32 and a depending leg 34. The radial leg 32 engages the rim 24 of the container 22 and supports the lid assembly 20. The depending leg 34 is longer than the radial leg 32 and extends downwardly to vertically overlap and surround the rim 24 of the container 22, maintaining the lid assembly 20 in position laterally relative to the rim 24 of the container 22.

The bottom periphery 30 extends through a rectangle that has two long sides 40, and rounded corners 42 that lead into outwardly bowed ends 44. The frame 26 includes sidewalls 36 and short walls 38 that extend upwardly from the radial leg 32 of the bottom periphery 30 in the direction opposite the depending leg 34. The sidewalls 36 extend upwardly from the radial leg 32 along the long sides 40 and the short walls 38 extend upwardly from the radial leg 32 along the outwardly bowed ends 44. Each of the bowed ends 44 define an offset 46 of the depending leg 34 to increase the radial dimension of the radial leg 32 along the offset 46.

The sidewalls 36 are generally parallel, spaced, shell-shaped, and facing one another. In addition, each sidewall 36 forms an upper concave central edge 48 that runs along the top of the sidewall 36. The sidewalls 36 have a higher elevation at the ends than in the middle, forming the concave edge 48. A pair of short walls 38 extend transversely between and connect the sidewalls 36. The short walls 38 are shorter in vertical height than the sidewalls 36 and present and terminate at lower edges 50.

Four S-shaped edges 52, one at each corner of the frame, interconnect the concave central edges 48 of the sidewalls 36 and the lower edges 50 of the short walls 38, as best illustrated in FIG. 1, to define opposed L-shaped openings 54 in the frame 26. The openings 54 are disposed between the central edges 48 and extend downward along the S-shaped edges 52 to the lower edges 50. The L-shaped openings 54 extend along the upper concave central edge 48 into the S-shaped edge 52, and then the L-shaped openings 54 extend down towards the short wall 38 and terminates at the lower edge 50.

The frame 26 also includes flanges 56 that extend from the upper concave central edges 48 into the L-shaped openings 54 and longitudinally into a portion of each S-shaped edge 52 which are at either end of each sidewall 36. Adjacent to the S-shaped edges 52, the flanges 56 define hinge holes 58 which are heart-shaped so that they define a radial inward protrusion. A pair of hinge pins 60 presented by the flaps 28 are disposed in the hinge holes 58 and the radial protrusion is a rocker point 62 on which the hinge pins 60 rest and about which the hinge pins 60 rotate or rock.

In addition to the frame 26, the lid assembly 20 includes a pair of identical movable closure flaps 28. The flaps 28 have an L-shaped cross-section or profile from a side view and they are complementary to and disposed in the L-shaped openings 54 of the frame 26. The L-shape of each of the flaps 28 defines a top leg 64 which has and terminates at an abutting end 66 and a shorter side leg 68 that has and terminates at a lower end 70. When the flaps 28 are in their closed position, the abutting ends 66 of the two flaps 28 are in abut one another. From the abutting ends 66, the top legs 64 of the flaps extend away from one another along the upper concave central edge 48 and into the S-shaped edge 52. The side leg 68 extends downward along the S-shaped edge 52 and to the lower ends 70 along the lower edges 50 of the short walls 38. In the closed position, the flaps 28, including the side legs 68, are shaped and disposed to completely fill the opposed L-shaped openings 54 defined by the frame 26.

The flaps 28 have gussets 72 extending between the top legs 64 and the side legs 68, and the hinge pins 60 extend from each of the gussets 72. The hinge pins 60 have a pill-shaped profile so that they present parallel rocking surfaces. The hinge pins 60 are disposed in the hinge holes 58 and the rocking surface of the hinge pin 60 engages and rests on the rocker point 62 of the hinge hole 58. The hinge pin 60 rotates or rocks over the rocker point 62 of the hinge hole 58 so the top legs 64 move down into the opening 54. As they rotate into the opening 54, the abutting ends 66 of the top legs 64 are no longer in abutting relationship, but move farther apart as the top legs 64 move or rotate into the opening 54 so that access to the container 22 is gained.

The flaps 28 have a center of mass between the rotational axis and the lower end 70 of the flap 28. The rotational axis of each flap 28 is between the abutting end 66 and the lower end 70 of the flaps 28. More specifically, the rotational axis is located where the parallel rocking surfaces of the hinge pins 60 engage and contact the rocker points 62 of the hinge holes 58. The center of mass creates a rotational moment of the flaps 28 due to gravity about the rotational axis and biases the flaps 28 towards the closed position with each side leg 68 engaging the adjacent flap jambs 74. The flap jambs 74 extend from the frame 26 into the opening 54 and along the S-shaped edges 52. The flap jambs 74 engage the side legs 68 and prevent the side legs 68 from entering the opening 54 when the flaps 28 are in the closed position.

Stops 76 are disposed adjacent the hinge holes 58 and extend from the flanges 56 and into the opening 54 of the frame 26. The stops 76 engage the gussets 72 of the flaps 28 at the fully open position and prevent the flaps 28 from moving past the fully open position. When each of the flaps 28 are at the fully open position, the top legs 64 of the flaps 28 have gone from abutting each other to being substantially parallel.

The frame has backstops 78 that extend from concave central edge 48 and are disposed between the side walls and the flanges 56 and are adjacent to the hinge holes 58. The backstops 78 engage the hinge pins 60 and limit the movement of the hinge pins 60 into the hinge holes, thus maintaining the lateral position of the flaps 28.

The frame 26 includes crossbeams 80 and a plurality of ribs 82, 84. The crossbeams 80 extend across the opening 54 and interconnect the flanges 56 adjacent each of the bowed ends 44. The crossbeams have a U-shaped cross-section such that there are two legs extending out in the same direction from a connecting member. A plurality of small ribs 82 are disposed on the interior of the sidewalls 36. They extend from the radial leg 32 of the bottom periphery 30 toward the concave central edge 48. A plurality of large ribs 84 are disposed on the interior of the sidewalls 36 with each disposed adjacent one of the rounded corners 42 and extending into an adjacent crossbeam 80.

Each of the flaps 28 also present embossments 86 and webs 88 to further complement the design of the lid. The embossments 86 have side ridges 90 that extend from the side legs 68 and into the top legs 64 with decreasing height approaching the abutting end 66 of the top leg 64. The ridges of the embossments 86 are aligned with the offsets 46 on the bowed ends 44 of the bottom periphery 30 section. The webs 88 are integral with the interior surface of each of the side legs 68 of the flaps 28.

A force may be applied to the top legs 64 to overcome the rotational moment of the flaps 28 about the rotational axis due to gravity and move the top legs 64 flaps into the opening to allow access through lid assembly 20 to the container 22. For example, a force with a component perpendicular to the top leg 64 and directed towards the container and located between the rotational axis and the abutting end 66 of the top leg 64 will create a rotational moment about the rotational axis in the opposite direction to the rotational moment created by the center of mass of the flap 28. As the counterweight bias towards the closed position is overcome, the hinge pins 60 rotate about the rocker points 62 as the top legs 64 of the flaps 28 move into the opening 54 to the open position.

The stops 76 engage the gussets 72 of the flaps 28 to prevent the flaps 28 from moving past the open position, i.e., limit the movement of the flaps to define the full open position. When the force is removed the flaps 28 return back towards the closed position as the rotational moment created by the center of mass rotates or rocks the hinge pins 60 over the rocker points 62.

Obviously, many modifications and variations of the present invention are possible in light of the above teachings and may be practiced otherwise than as specifically described while within the scope of the appended claims. That which is prior art in the claims precedes the novelty set forth in the "characterized by" clause. The novelty is meant to be particularly and distinctly recited in the "characterized by" clause whereas the antecedent recitations merely set forth the old and well-known combination in which the invention resides. These antecedent recitations should be interpreted to cover any combination in which the inventive novelty exercises its utility. The use of the word "said" in the apparatus claims refers to an antecedent that is a positive recitation meant to be included in the coverage of the claims whereas the word "the" precedes a word not meant to be included in the coverage of the claims. In addition, the reference numerals in the claims are merely for convenience and are not to be read in any way as limiting.

What is claimed is:

1. A lid assembly (20) for a container (22) of the type presenting an endless top rim (24), said lid assembly comprising;

a frame (26) having a bottom periphery (30) for engaging the rim (24) of the container (22), a pair of parallel and spaced sidewalls (38) extending from said bottom periphery (30), said bottom periphery (30) presenting lower edges (50) extending between said sidewalls (38), characterized by said sidewalls (38) each being shell-shaped and presenting an interior surface facing one another with each having an upper concave central edge (48) and interconnected by said lower edges (50) to define opposed L-shaped openings (54) in said frame (26) disposed between said central edges (48) and extending downward to said lower edges (50), a pair of identical movable closure flaps (28) each having an L-shaped cross-section complementary to and disposed in said L-shaped openings (54) and abutting one another at respective abutting ends (66) to extend away from one another along said central edge (28) and downward to a lower end (70) along said lower edges (50) in a closed position.

2. An assembly (20) as set forth in claim 1 including a hinge device connecting said flaps (28) to said frame (26) for rotation from said closed position to an open position about a rotational axis disposed between said abutting end (66) and said lower end (70) of said flaps (28).

3. An assembly (20) as set forth in claim 2 further characterized by each of said flaps (28) having a center of mass between said rotational axis and said lower end (70) to bias each of said flaps (28) to said closed position.

4. An assembly (20) as set forth in claim 3 including flap jambs (74) extending from said frame (26) into said opening (54) for engaging and preventing said flaps (28) from entering said opening (54) in said closed position.

5. An assembly (20) as set forth in claim 4 including S-shaped edges (52) interconnecting said concave central edges (48) and said lower edges (50) to define said opposed L-shaped openings (54), said flap jambs (74) extending along said S-shaped edges (52).

6. An assembly (20) as set forth in claim 2 wherein said hinge device includes hinge holes (58) defined by said frame (26) and hinge pins (60) extending from said flaps (28).

7. An assembly (20) as set forth in claim 6 further characterized by each of said hinge holes (58) being heart-shaped to define a radially inward protrusion defining a rocker point (62), said hinge pins (60) presenting parallel rocking surfaces and disposed in said hinge holes (58) with said rocker point (62) of each of said hinge holes (58) engaging one surface of said hinge pin (60) therein.

8. An assembly (20) as set forth in claim 6 further characterized by said L-shaped cross-section of said flaps (28) defining a top leg (64) and a side leg (68) complementary to and disposed in said L-shaped openings (54) with said top legs (64) abutting one another at said respective abutting ends (66) and with said side legs (68) presenting an interior surface facing said frame (26) and extending downward to said lower edges (50) in said closed position and defining said lower end (70), and including webs (88) integral with each of said side legs (68) of said flaps (28) on said interior surface thereof.

9. An assembly (20) as set forth in claim 8 including side gussets (72) extending between said top legs (64) and said side legs (68) of said flaps (28), and flanges (56) extending from each of said upper concave central edges (48) and into said opening (54).

10. An assembly (20) as set forth in claim 9 further characterized by said flanges (56) defining said hinge holes (58), and said hinge pins (60) extending from each of said gussets (72) and into said hinge holes (58).

11. An assembly (20) as set forth in claim 10 including stops (76) extending from said flanges (56) and into said opening (54) and disposed adjacent said hinge holes (58) for engaging said gussets (72) in said open position.

12. An assembly (20) as set forth in claim 6 including backstops (78) extending from said concave central edges (48) and disposed between each of said sidewalls (36) and said flanges (56) and adjacent said hinge holes (60) for engaging said hinge pins (60) and limiting movement of said hinge pins (60) into said hinge holes (58).

13. An assembly (20) as set forth in claim 10 further defined by said bottom periphery (30) extending through a rectangle having long sides (40) and rounded corners (42) and outwardly bowed ends (44), and said bottom periphery (30) having an L-shaped cross-section defining a radial leg (32) for engaging the rim (24) of a container (22) and a depending leg (34) for surrounding and overlapping the rim (24) of the container, with said depending leg (34) being longer than said radial leg (32), and with said sidewalls (36) extending upwardly from said radial leg (32) and along said long sides (40), and a pair of short walls (38) extending upwardly from said radial leg (32) between said sidewalls (36) to present said lower edges (50), and said bowed ends (44) each defining an offset (46) of said depending leg (34) projecting radially outwardly relative to said short walls (38).

14. An assembly (20) as set forth in claim 13 further characterized by each of said flaps (28) presenting an embossment (86) having side ridges (90) extending from said side legs (68) into said top legs (64) with decreasing height approaching said abutting end (66) of said top leg (64), and said ridges (90) of said embossments (86) being aligned with said offsets (46) on said bowed ends (44) of said bottom periphery (30) section.

15. An assembly (20) as set forth in claim 13 further characterized by said frame (26) including crossbeams (80) having a U-shaped cross-section and extending across said opening (54) and interconnecting said flanges (56) adjacent each of said bowed ends (44), and a plurality of large reinforcing ribs (84) disposed on said interior of said sidewalls (36) with each disposed adjacent one of said rounded corners (42) and extending into an adjacent crossbeam (80), and a plurality of small ribs (82) disposed on said interior of said sidewalls (36) and extending from said radial leg (32) of said bottom periphery (30) toward said concave central edge (48).

16. A lid assembly (20) for a container (22) of the type presenting an endless top rim (24), said lid assembly (20) comprising;

a frame (26) having a bottom periphery (30) for engaging the rim (24) of the container (22), said bottom periphery (30) having an L-shaped cross-section defining a radial leg (32) for engaging the rim (24)

of the container (22) and a depending leg (34) for surrounding and overlapping the rim (24) of the container (22), said depending leg (34) being longer than said radial leg (32), said bottom periphery (30) extending through a rectangle having long sides (40) and rounded corners (42) and outwardly bowed ends (44), a pair of generally parallel and spaced sidewalls (36) extending upwardly from said radial leg (32) and along said long sides (40), a pair of short walls (38) extending upwardly from said radial leg (32) between said sidewalls (36) to present lower edges (50), each of said bowed ends (44) each defining an offset (46) of said depending leg (34) projecting radially outwardly relative to said short walls (38), characterized by said sidewalls (36) each being shell-shaped and presenting an interior surface facing one another with each having an upper concave central edge (48) and S-shaped edges (52) interconnecting said central edges (48) and said lower edges (50) to define opposed L-shaped openings (54) in said frame (26) disposed between said central edges (48) and extending downward along said S-shaped edges (52) to said lower edges (50), a pair of identical movable closure flaps (28) each having an L-shaped cross-section defining a top leg (64) and a side leg (68) complementary to and disposed in said L-shaped openings (54) with said top legs (64) each having an abutting end (66) that abut one another and extend away from one another along said upper concave central edge (48) and said side legs (68) present an interior surface facing said frame (26) and extend downward along said S-shaped edges (52) to a lower end (70) and along said lower edges (50) in a closed position, said frame (26) including flanges (56) extending from each of said upper concave central edges (48) and into said opening (54) and longitudinally into a portion of each of said S-shaped edges (52), said flanges (56) defining hinge holes (58) being heart-shaped to define a radially inward protrusion defining a rocker point (62) adjacent each of said S-shaped edges (52), said flaps (28) having side gussets (72) extending between said top legs (64) and said side legs (68) thereof, said hinge pin (60) extending from each of said gussets (72) and presenting parallel rocking surfaces and disposed in said hinge holes (58) with said rocker point (62) of each of said hinge holes (58) engaging one side of said hinge pin (60) therein, a hinge device having said hinge holes (58) and said hinge pins (60) connecting said flaps (28) with said frame (26) for rotation from said closed position to an open position about a rotational axis disposed between said abutting ends (66) and said lower ends (70), said frame (26) having backstops (78) extending from said concave central edges (48) and disposed between each of said sidewalls (36) and said flanges (56) adjacent said hinge holes (58) for engaging said hinge pins (60) and limiting movement of said hinge pins (60) into said hinge holes (58), stops (76) extending from said flanges (56) and into said opening (54) and disposed adjacent said hinge holes (58) for engaging said gussets (72) in a fully open position, said frame (26) having flap jambs (74) extending from said frame (26) into said opening (54) and along said S-shaped edges (52) and engaging and preventing said side legs (68) of said flaps (28) from entering said opening (54) in a closed position, each of said flaps (28) presenting an embossment (86) having side ridges (90) extending from said side legs (68) into said top legs (64) with decreasing height approaching said abutting end (66) of said top leg (64), said ridges (90) of said embossments (86) being aligned with said offsets (46) on said bowed ends (44) of said bottom periphery (30) section, said frame (26) including crossbeams (80) having a U-shaped cross-section and extending across said opening (54) and interconnecting said flanges (56) adjacent each of said bowed ends (44), a plurality of small ribs (82) disposed on said interior surface of said sidewalls (36) and extending from said radial leg (32) of said bottom periphery (30) toward said concave central edge (48), a plurality of large reinforcing ribs (84) disposed on said interior surface of said sidewalls (36) with each disposed adjacent one of said rounded corners (42) and extending into an adjacent said crossbeam (80), said flaps (28) including webs (88) integral with each of said side legs (68) on said interior surface of said side legs (68), said flaps (28) having a center of mass between said rotational axis and said lower end (70) of said side legs creating a rotational moment of said flaps (28) due to gravity about said rotational axis being located where said rocker points (62) engage said parallel rocking surfaces for biasing said flaps (28) to said closed position with each said side leg (68) engaging the adjacent said flap jambs (74), and whereby a force may be applied to said top legs (64) to overcome said rotational moment of said flaps (28) about said rotational axis due to gravity to move said top legs (64) into said opening (54) as said hinge pins (60) rotate about said rocker points (62) to said open position with said stops (76) engaging said gussets (72) of said flaps (28) to prevent said flaps (28) from moving past said open position and whereby said flaps (28) return to said closed position upon removal of said force.

* * * * *